US005201255A

United States Patent [19]

Gegg

[11] Patent Number: 5,201,255

[45] Date of Patent: Apr. 13, 1993

[54] RATCHET WRENCH

[76] Inventor: Michael J. Gegg, 591 Soniat Ave., New Orleans, La. 70123

[21] Appl. No.: 852,793

[22] Filed: Mar. 17, 1992

Related U.S. Application Data

[63] Continuation-in-part of Ser. No. 9,727, Feb. 2, 1987, abandoned.

[51] Int. Cl.[5] ..... B25B 17/00

[52] U.S. Cl. ..... 81/57.29; 81/62

[58] Field of Search ..... 81/57.29, 60, 61, 62, 81/58.1, 58.3, 63.1, 177.85

[56] References Cited

U.S. PATENT DOCUMENTS

| | | | |
|---|---|---|---|
| 3,707,893 | 1/1973 | Hofman | 81/58.1 |
| 3,952,617 | 4/1976 | Gegg | 81/62 |
| 4,137,801 | 2/1979 | Imperio | 81/58.1 |
| 4,218,940 | 8/1980 | Main | 81/63 |
| 4,545,267 | 10/1985 | Shumway | 81/57.29 |

*Primary Examiner*—M. Rachuba

[57] ABSTRACT

This invention relates to a socket wrench which is capable of loosening or tightening a nut or bolt by either rotation of the wrench in a direction conducive to effect such tightening or loosening in a conventional manner or by rotation of the wrench handle along its longitudinal axis. The wrench provides a ratcheting action so that the initial positions of the wrench or the wrench handle can be reachieved during tightening or loosening.

20 Claims, 7 Drawing Sheets

RATCHET WRENCH

This is a continuation-in-part of co-pending U.S. patent application Ser. No. 07/009,727, filed Feb. 2, 1987, now abandoned, and hereby incorporated by reference.

BACKGROUND OF THE INVENTION

1. Field Of The Invention

The present invention relates to a ratchet wrench having two modes of operation and which is characterized by a small head and simplicity of construction and operation. One mode is the conventional mode whereby the bar is swung back and forth to progress the socket holding means; the other mode shall be called "speed ratcheting" and is achieved by ratcheting the handle along its longitudinal axis. This is made possible by the coordination of a coupling gear and a tandem ratcheting mechanism between the socket holding member and the grip.

2. General Background

Considerable attention has been placed on the development of ratchet wrenches with smaller heads, which wrenches are thus capable of being used in close quarters. The limiting factor in reducing the size of the ratchet head in conventional ratchets has been the strength of the teeth and the pawls. State of the art conventional ratchet wrenches have smaller heads than older models even though the ratcheting mechanisms continue to be incorporated in the lead. This is made possible by the use of alloys with greater strength and proper positioning of the pawls.

Several patents have been granted for ratcheting devices which have the conventional mode of ratcheting facility combined with another mode made possible by gear action between the work engaging piece and a rotatable handle. This action enables the user to tighten or loosen a nut or bolt by rotation of the handle along the longitudinal axis. The introduction of these devices demonstrates that conventional ratchet trenches even with smaller heads do not meet all the requirements in working on modern congested engines. There is a need for the dual mode type ratchet wrench. However, these devices characteristically have very large heads and numerous working parts. The heads are much larger than the heads of conventional ratchets because both the ratchet mechanism and the mitre gears must be housed in the same area. In short, these tools are not practical to manufacture and/or operate.

U.S. Pat. No. 3,952,617 disclosed a ratchet wrench having two modes of operation as thus described. In this design the ratcheting mechanisms are in the handle making it possible to reduce the size of the head considerably. The limiting factor in reducing the size of the head in this tool is the strength of the mitre gears and the shaft. In conventional ratcheting the torque from the work engaging member must be transmitted through the gears and shaft to the ratchets in the handle. This tool went further than any prior ratchet wrench in achieving the dual mode of operation and featuring a small head. However, the numerous and complex parts make it expensive to manufacture. Also, the rotation of the handle along its center longitudinal axis is limited to rotation in one direction in a given setting as the torque in conventional ratcheting is transmitted from one pawl through the rotatable handle to the second pawl. The user must remove his or her grasp from the handle after each stroke and re-grip. The handle cannot be ratcheted along its center longitudinal axis.

SUMMARY OF THE INVENTION

The tool described herein is a dual mode type ratchet Wrench. It achieves a unique status in that its head can be made smaller than state of the art conventional ratchet wrenches and the simplicity of design makes it easy to make and operate. The head is very small because the mitre gears are the only functional parts housed therein. The small head allows the facility of reaching into confined areas and tightening or loosening a nut or bolt without having to swing the bar as in conventional ratcheting. The user can grasp the handle and rotate it back and forth along its center longitudinal axis and thus progress the tightening or loosening of a bolt or nut without removing his or her hand from the handle. In other words, the user can ratchet the handle along the center longitudinal axis to progress the work piece. Another feature of this tool is that the user in a continuous motion, without switching can bear down on the handle as in conventional ratcheting to fully tighten a nut or bolt. Similarly, in loosening a nut or bolt the process can be achieved in a continuous motion. The nut or bolt is broken loose by bearing down on the handle and then in a continuous action, without the user removing his or her grasp from the handle can rotate same back and forth along its center longitudinal axis and progress the nut or bolt loose.

A still further objective of this invention is to achieve transmission of the required torque from the work engaging piece through the gears and shaft to the ratchet mechanism in the handle. The diameter and length of the shaft are critical in this objective. The arrangement of the shaft in this invention is such that it is reduced in length to the possible minimum; it extends from the pinion gear to the closest point of the rotatable handle. The shaft can also be made as large in diameter as is necessary without encumbering any other functional part.

In summary, the tool described in this document achieves what the numerous dual mode designs attempt to achieve but at the same time eliminates the characteristically large head. It accomplishes a smaller head than even state of the art conventional ratchets. It is a tool which is practical to make and operate.

In specific form, the tool described herein is a lever frame having a socket holding housing fixed on one extremity, a socket holding means being rotatably mounted in said housing; an enlarged bell housing fixed to other extremity and having its inside bore concentric with its outside shoulder; an elongated cylindrical grip rotatably mounted on the bell housing shoulder, said grip having concentric bores for rotation on the said shoulder and positioning and rotation of a tandem ratcheting means; a shaft rigidly attached to the tandem ratcheting means and extending through lever frame and engaged functionally with the socket holding means by a pinion gear fixed on the other end of the shaft and meshing with a mitre gear on the internal surface of the socket holding means.

The enlarged bell housing and the elongated cylindrical grip each having internal ring gears which the tandem ratcheting means engage to determine direction of rotation of the shaft and grip.

The tandem ratcheting means is a cylindrical carrier with two slots cut at 180° apart, each slot accommodating a pivoting pawl, the pawls having teeth shaped and positioned to engage the ring gears in the bell housing and elongated grip. The pawls are placed at 180° apart to prevent jamming of the carrier housing. It has been determined that the dynamics of ratcheting in this device create jamming of the tandem pawls when both pawls are placed on the same side. Best results are obtained when pawls are spaced at 180° apart. The engagement of the tandem pawls to the internal ring gears of the bell housing and grip are oriented by a selection device which is a rod rotatably coupled with the tandem carrier. The rod has a pawl movement structure for each pawl so as to move each pawl to its respective first and second position upon rotative movement of the rod. In the first position the shaft can be rotated in a clockwise direction only, allowing conventional ratcheting of the work engaging member in a counter-clockwise direction only and at the same time functionally disposed to be urged in the same direction by rotating the handle back and forth along its center longitudinal axis. In the second mode the shaft can be rotated in a counterclockwise direction only, allowing conventional ratcheting of the work engaging member in a clockwise direction only and at the same time functionally disposed to be urged in the same direction by rotating the handle back and forth along its center longitudinal axis. In other words, in both positions the handle can be ratcheted along its center longitudinal axis to progress rotation of the work engaging piece.

Due to the unique features of the wrench of this invention, simple construction is possible. Further, various features of the wrench allow for the utilization of parts which are of a thermoplastic material, thereby reducing the overall cost of the wrench.

BRIEF DESCRIPTION OF THE DRAWINGS

For a further understanding or the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
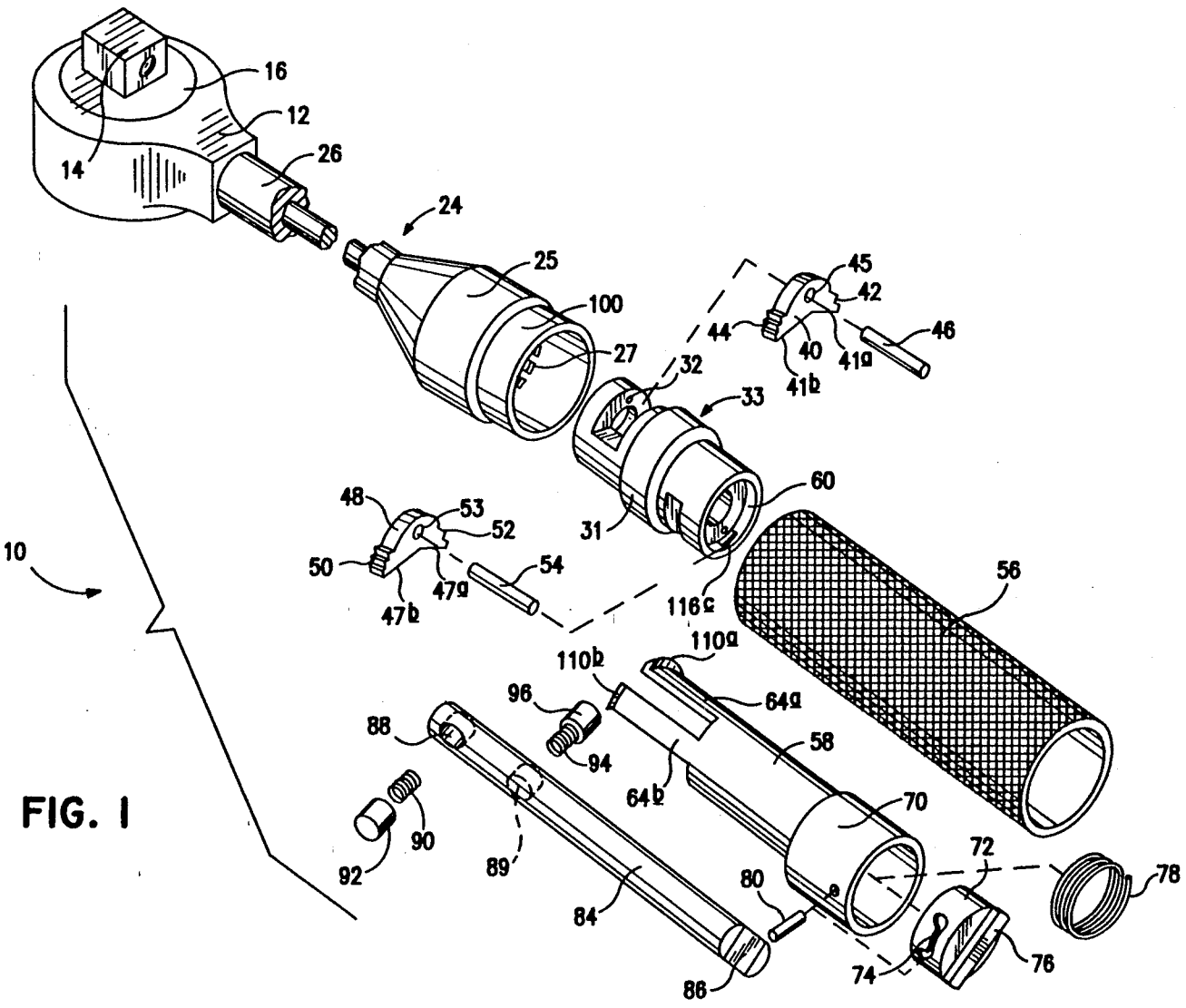
FIG. 1 is an enlarged, partially broken away, view of a wrench of this invention.
Figure 2:
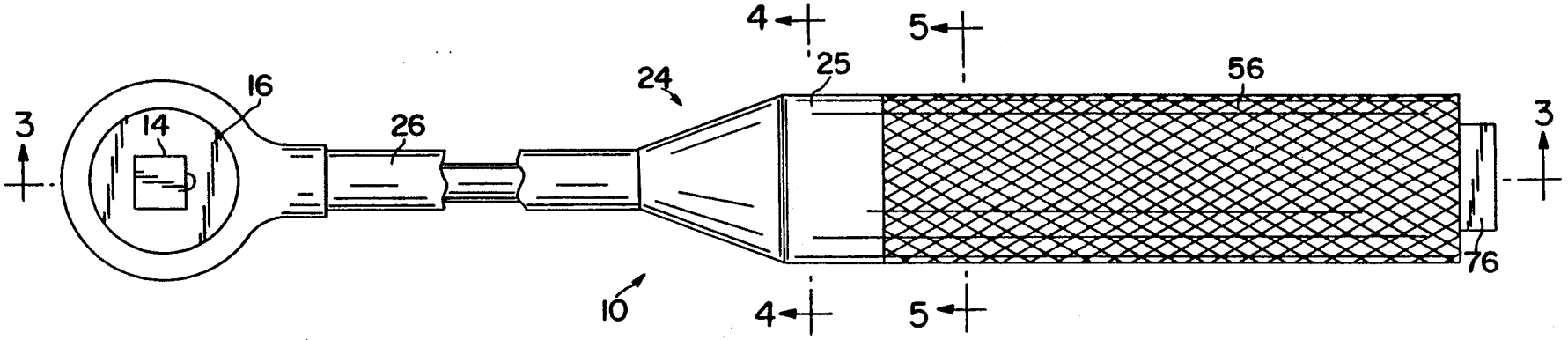
FIG. 2 is a top plan view, partially broken away, of the wrench shown in FIG. 1.

Referring now to the drawings, it can be seen that a wrench of this invention is generally designated by the numeral 10. Wrench 10 is elongated and has at one of its ends a conventional male socket attachment 14 for receiving a socket (not shown). Male socket attachment 14 is rigidly mounted to circular plate 16 which rotatably seats within gear housing 12. Male socket attachment 14 is rotatably mounted within gear housing 12 by way of mount 19 which is rotatably mounted to bottom plate 13. Connected to the bottom surface of plate 16 is master bevel gear 17 which is in gear-meshing relationship with drive bevel gear 15. Gear housing 12 is rigidly connected to an elongated hollow housing, generally designated by the numeral 24. Hollow housing 24 has a cylindrical portion 26 and a bell housing portion 25.

Figure 3:
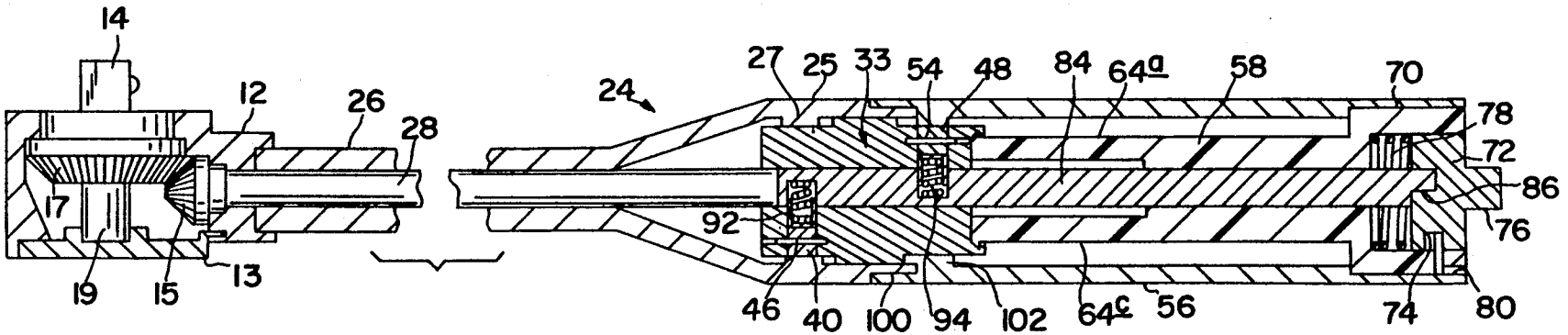
FIG. 3 is a sectional view taken along sectional lines 3—3 in FIG. 2.
Figure 7:
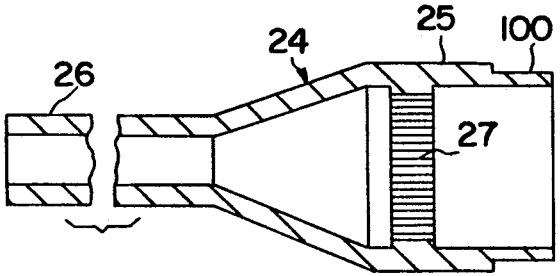
FIG. 7 is a sectional view of the elongated hollow housing feature of the wrench shown in FIG. 1.
Figure 8:
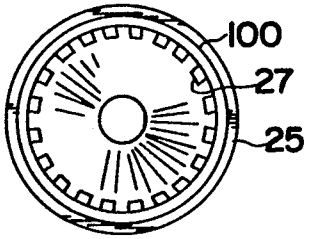
FIG. 8 is an end view of the elongated hollow housing feature of the wrench shown in FIG. 1.

Rotatably located within hollow housing 24 is drive shaft 28. Drive shaft 28 has at one of its ends drive bevel gear 15 rigidly affixed thereto. At the other end of drive shaft 28 is rigidly affixed a carrier, which is generally designated by the numeral 33. As can be seen in FIG. 3, a portion of carrier 33 is located within bell housing portion 25.

Figure 11:
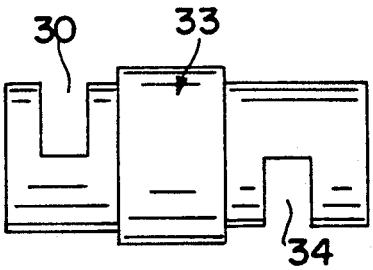
FIG. 11 is a side plan view of the carrier component of the wrench shown in FIG. 1.
Figure 12:
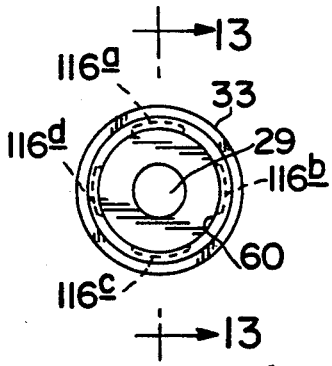
FIG. 12 is an end view of the carrier shown in FIG. 11.
Figure 13:
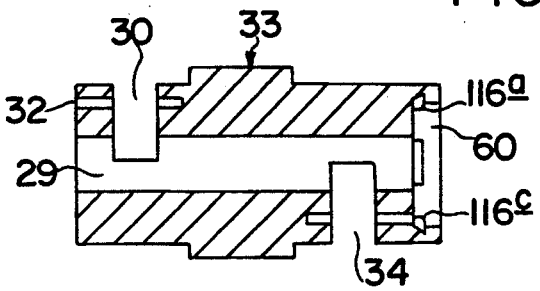
FIG. 13 is a sectional view taken through section lines 13—13 in FIG. 12.
Figure 14:
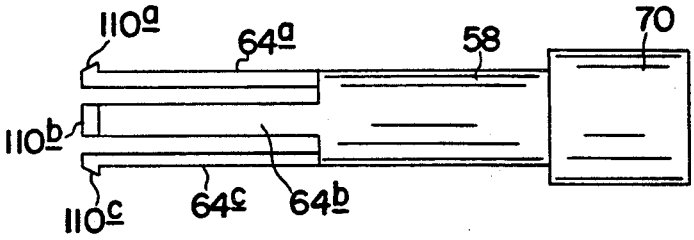
FIG. 14 is the rod housing component of the wrench shown in FIG. 1.

Carrier 33 has a bore 29 (FIG. 12) for receipt of selection rod 84 (FIGS. 1,3). Selection rod 84 is rotatably held within bore 29. Carrier 33 has first recess 30 and second recess 34 (FIG. 11, 13). For the embodiment shown in the drawings, these recesses are in 180° relationship. Pivotally mounted within first recess 30 is pawl 40. Pawl 40 is pivotally mounted by way of pivot pin 46 which fits through pawl aperture 45 and carrier aperture 32. Pawl 48 is pivotally mounted within second recess 34 by the fit of pivot pin 54 through pawl aperture 53 and carrier aperture 36 which is seen in FIG. 13. Pawls 40 and 48 each have a pair of engaging teeth which are designated by the numerals 42 and 44 for pawl 40 and by the numerals 50 and 52 for pawl 48. Pawl 40 has lower surfaces **41*a* and 41*b* which meet at an obtuse angle. Likewise, pawl 48 has lower surfaces 47 and 47*b* which also meet at an obtuse angle. These pawls are each movable to a first and second position and are engagable with ring gears 27 and 102 to provide control of the direction of rotation for carrier 33 and shaft 28** as hereinafter described.

Carrier 33 has a waist portion 31 which is of an enlarged diameter and which provides a bearing surface between carrier 33 and a portion of the inside surface of bell housing portion 25 when carrier 33 is partially positioned therewithin. See FIG. 3. When carrier 33 is so positioned, pawl 40 is in location for achieving engagement with ring gear 27 which is about the inside surface of a portion of bell housing portion 25. As can be seen in FIG. 3, carrier 33 has a portion which extends rearwardly of bell housing portion 25.

Hollow handle 56 is rotatably mounted to the rear portion of bell housing portion 25. So as to provide an aesthetically pleasing mount, the rear portion of bell housing portion 25 has an annular recess 100. Nested within this recess is annular portion 101 of hollow handle 56. Handle 56 has ring gear 102 which is engagable with pawl 48 when handle 56 is mounted to bell housing portion 25.

Figure 15:
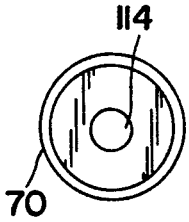
FIG. 15 is an end view of the rod housing shown in FIG. 14.
Figure 16:
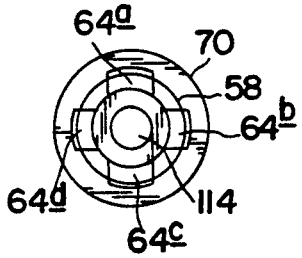
FIG. 16 is a sectional view taken along section lines 4—4 in FIG. 2, showing the first shaft rotation control device in the first position.

Housed within hollow handle 56 is rod casing 58. Rod casing 58 has, at its forwardmost end, four arms, 64*a*, 64*b*, 64*c* and 64*d*, which each have a boss, 110*a*, 110*b*, 110*c* and 110*d*, respectively, achieving a snap fit with recesses 116*a*, 116*b*, 116*c*, and 116*d*, which are located within annular recess 60 in the end of carrier 33. See FIGS. 12 and 13. With this snap fit, rod casing 58 is locked together with carrier 33. Rotatably mounted within bore 114 (See FIG. 15) of rod casing 58 is rod 84. Rod 84 abuts the rearwardmost end of drive shaft 28. Rod 84 has two cavities, cavities 88 and 89, which are 180° offset and longitudinally displaced from one another. Seated in cavity 88 is spring 90. Spring cap 92 caps the upper end of spring 90. Seated within cavity 89 is spring 94 with spring cap 96 capping the upper end of spring 89. The locations of the cavities, springs and spring caps is such that spring cap 92 bears against either surface 41*a* or 41*b* of pawl 40 and spring cap 96 bears against either surface 41*a* or 41*b* of pawl 40 and spring cap 96 bears against either surfaces 47*a* and 47*b* of pawl 48. At the rearward end of rod 84 is key 86 which fits within a key slot (see FIG. 3) in selector knob 72. Key 86 and the key slot ensure that rotation of selector knob 72 imparts a rotation to rod 84. For convenience sake, selector knob 72 has, at its rearward end, knob handle 76. Selector knob 72 is spring-loaded, see spring 78, into the larger diameter portion 70 of rod casing 58. Stop pin 80 holds selector knob 72 in position and indicates, in conjunction with slot 74, the degree of rotation desired to achieve positioning of pawls 40 and 48 as hereinafter described. Stop pin 80 is held in aperture 82.

As hereinafter described, it will be seen how the rotation of rod 84 locates spring caps 92 and 96 with respect to surfaces 41*a* and 41*b* and 47*a* and 47*b*, respectively, to enable the user of wrench 10 to select and achieve the positioning of pawls 40 and 48 in their first and second positions to determine the direction of the rotation of shaft 28 during use of wrench 10.

Various components of wrench may be made of thermoplastic materials which reduce the weight of the wrench and contribute to its economic manufacture. For example, rod casing 58, rod 84 and selector knob 72 may all be of high strength thermoplastic materials. Provided that a suitable high strength thermoplastic material is used in consideration of the types of forces expected to be experienced by the wrench, carrier 33 may also be of a thermoplastic material.

Figure 5:
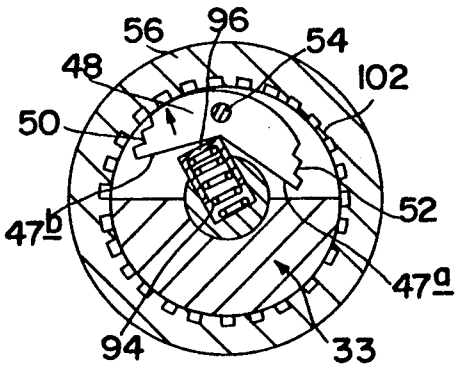
FIG. 5 is a sectional view taken along section lines 5—5 in FIG. 2, showing the second shaft rotation control device in the second position.
Figure 6:
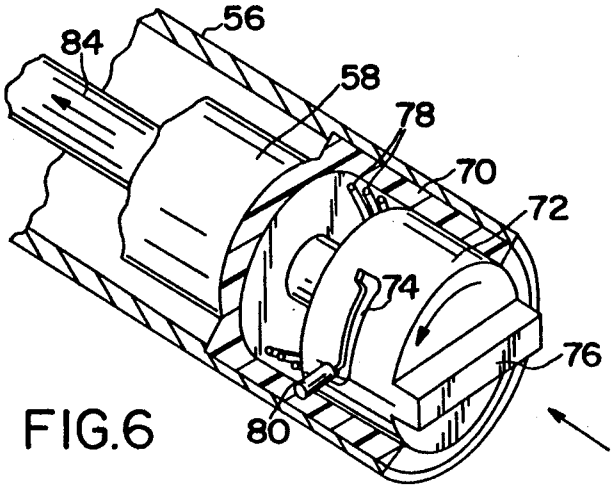
FIG. 6 is a broken away view of the end of the wrench opposite the socket-holding structure.
Figure 4:
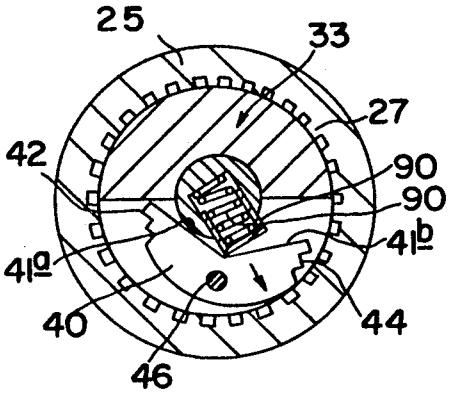
FIG. 4 is a sectional view taken along sectional lines 4—4 in FIG. 2, showing the first shaft rotation control device in the second position.
Figure 9:
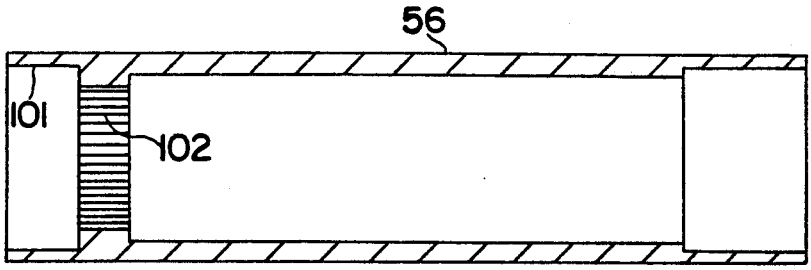
FIG. 9 is a sectional view taken along section lines 9—9 in FIG. 10.
Figure 10:
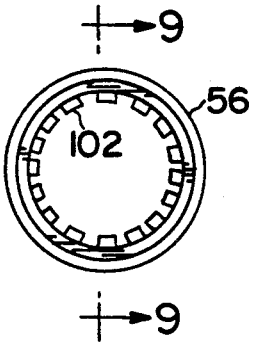
FIG. 10 is an end view of the handle component of the wrench shown in FIG. 1.

As mentioned previously, the wrench of this invention is capable of tightening or loosening a nut or bolt with a ratchet action in two different modes. One of the modes resembles conventional ratcheting motion, i.e., wrench 10 is rotated about and in a plane substantially perpendicular to the thread axis of the nut or bolt to be tightened. To accomplish tightening, the user would turn selector knob 72 to the second position to thereby cause rod 84 to rotate to position spring cap 92 onto surface 41*b*, causing pawl 40 to rock or pivot about pin 46 so that pawl teeth 44 engage the teeth of ring gear 27 as is seen in FIG. 4. Counterclockwise (lefthand) rotation of carrier 33 and shaft 28 is permitted as teeth of ring gear 27 simply ride over the top of pawl 40 in a ratchet-like manner. However, clockwise (righthand) rotation of carrier 33 and shaft 28 is prevented as pawl teeth 44 achieve locking engagement with the teeth of ring gear 27. The rotation of selector knob 72 to the second position also causes spring cap 96 to engage surface 47*b* of pawl 48. See FIG. 5. In this position, handle 56 is free to rotate, about its longitudinal axis, relative to carrier 33, in a counterclockwise (lefthand) direction while, at the same time, is not permitted to rotate with respect to carrier 33 in a clockwise direction (righthand) as, in the latter case, pawl teeth 50 are in locking engagement with the teeth of ring gear 102. With the above engagements achieved, wrench 10 is then rotated in clockwise rotation to turn the male socket attachment 14 in the same rotation to achieve tightening of the nut or bolt. With no counterclockwise rotation of shaft 28 being allowed, male socket attachment 14 has to follow the rotation of wrench 10. This shaft rotation is prevented by the locking of pawl teeth 44 and the teeth of ring gear 27 so that carrier 33 is unable to rotate and thus neither is drive shaft 28 which is rigidly affixed to carrier 33.

Figure 17:
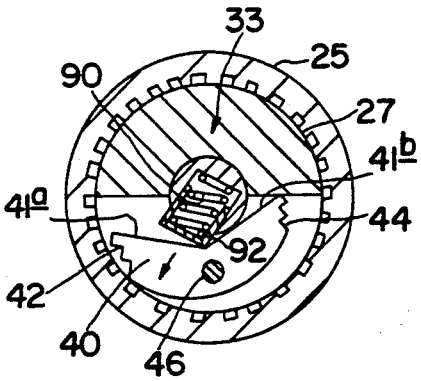
FIG. 17 is a sectional view taken along section lines 5—5 in FIG. 2, showing the second shaft rotation control device in the first position.
Figure 18:
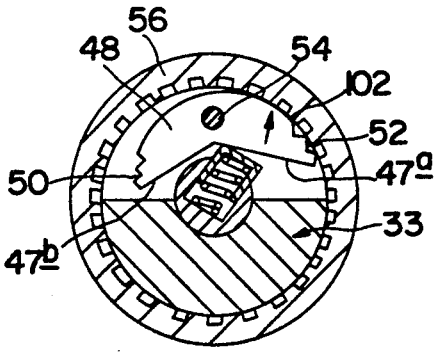
FIG. 18 is a view, similar to FIG. 17, showing the second shaft rotation control device in the second position.

To achieve loosening of the nut or bolt, selector knob 72 is turned to the first position (See FIGS. 17 and 18) so that spring cap 92 engages surface 41*a* of pawl 40, thereby rocking pawl 40 so that pawl teeth 42 come into engagement with the teeth of ring gear 27. Thus, clockwise rotation of carrier 33 and shaft 28, which is rigidly attached thereto, is now permitted while counterclockwise rotation is prevented. At the same time, pawl 48 is rocked by the engagement of spring cap 96 with surface 47*a* so that pawl teeth 52 come into engagement with the teeth of ring gear 102. In this position, clockwise rotation of handle 56 imparts a clockwise rotation to shaft 28 and carrier 33. Counterclockwise rotation of handle 56 imparts no rotation to shaft 28 or carrier 33 as pawl 48 is not engaged with ring gear 102 in this rotation.

In the other mode of operation, tightening or loosening of a nut or bolt can be achieved, respectively, by simple counterclockwise and clockwise rotation of handle 56. The selector knob 72 is set as before described for the conventional ratcheting action so that the pawl positions are realized for tightening or loosening. However, application of rotation to male socket attachment 14 is achieved by rotating handle 56. To achieve tightening, handle 56 is rotated in a counterclockwise fashion and selector knob 72 is set so that pawl 48 achieves locking engagement with ring gear 102 when handle 56 is rotated in a counter-clockwise direction. Thus, counter-clockwise rotation of handle 56 imparts a like rotation to carrier 33 and, as a result, to shaft 28 which is affixed to carrier 33. Pawl 40, when this mode of tightening is being used, is in a position so that the teeth of ring gear 27 are not in engagement with pawl teeth 44 during counterclockwise rotation of carrier 33, as is shown in FIG. 4.

Loosening of the nut or bolt is achieved by rotation of handle 56 in a clockwise rotation with selector knob 72 set to engage end cap 92 with surface 41*a* of pawl 40 and end cap 96 with surface 47*a* of pawl 48. In this manner, pawls 40 and 48 are rocked or pivoted to a position so that pawl teeth 42 and 52, respectively, are capable of making engagement with the teeth of ring gears 27 and 102, teeth 42, thereby preventing counterclockwise rotation of carrier 33 and thus shaft 28—clockwise rotation is however allowed. Pawl teeth 52 are at the same time in locked engagement with the teeth of ring gear 102 so that counterclockwise rotation of handle 56 imparts a counterclockwise rotation to carrier 33 and thus to shaft 28.

Another feature of the wrench of this invention is that both modes may be used simultaneously, i.e., the conventional swinging motion described above can occur at the same time that the handle rotation mode is utilized. This will result in a faster rate of rotation for master bevel gear 17, thereby providing a faster rate of tightening or loosening.

Figure 19:
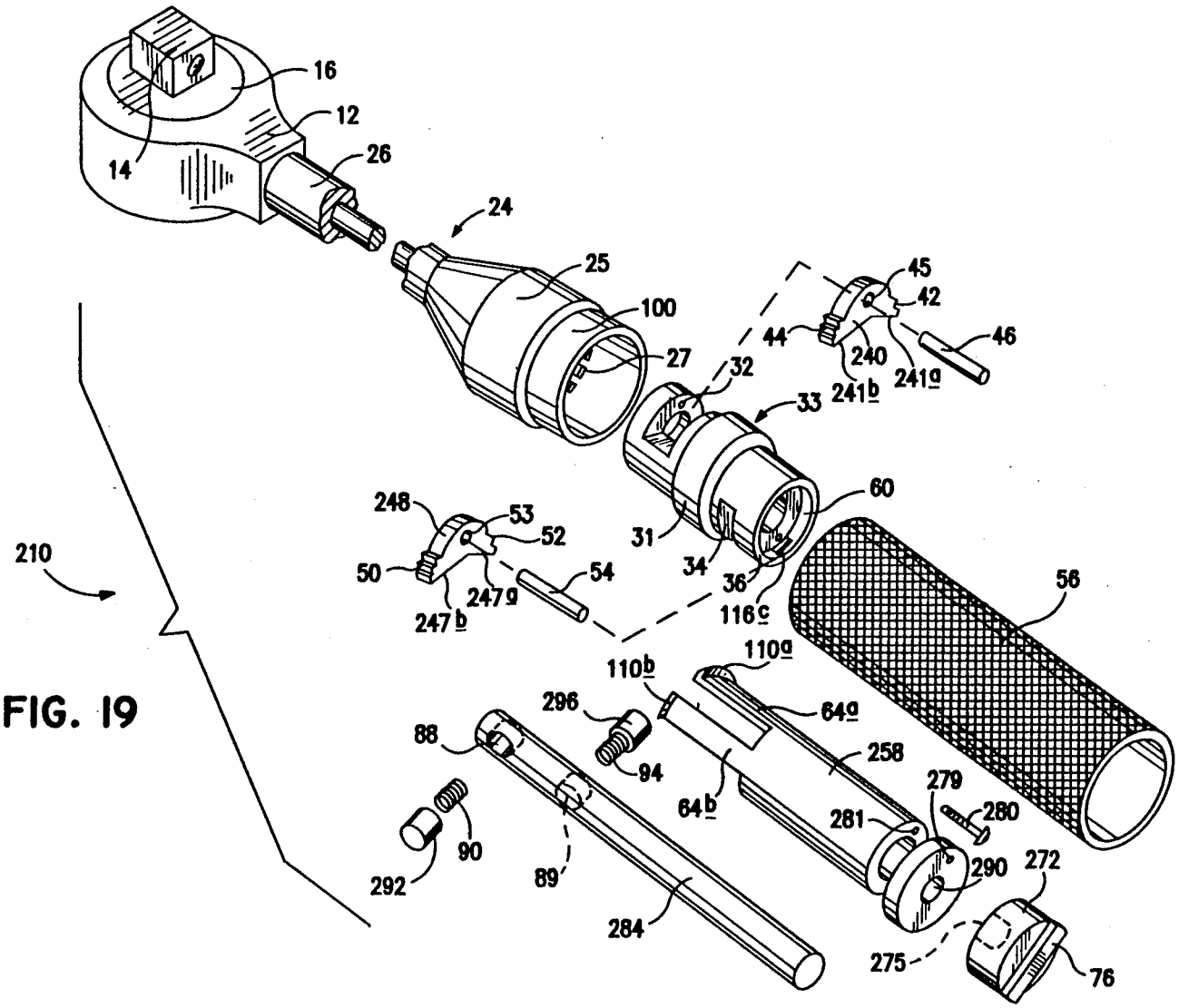
FIG. 19 is a partially exploded view of the wrench of the preferred embodiment of the present invention.
Figure 20:
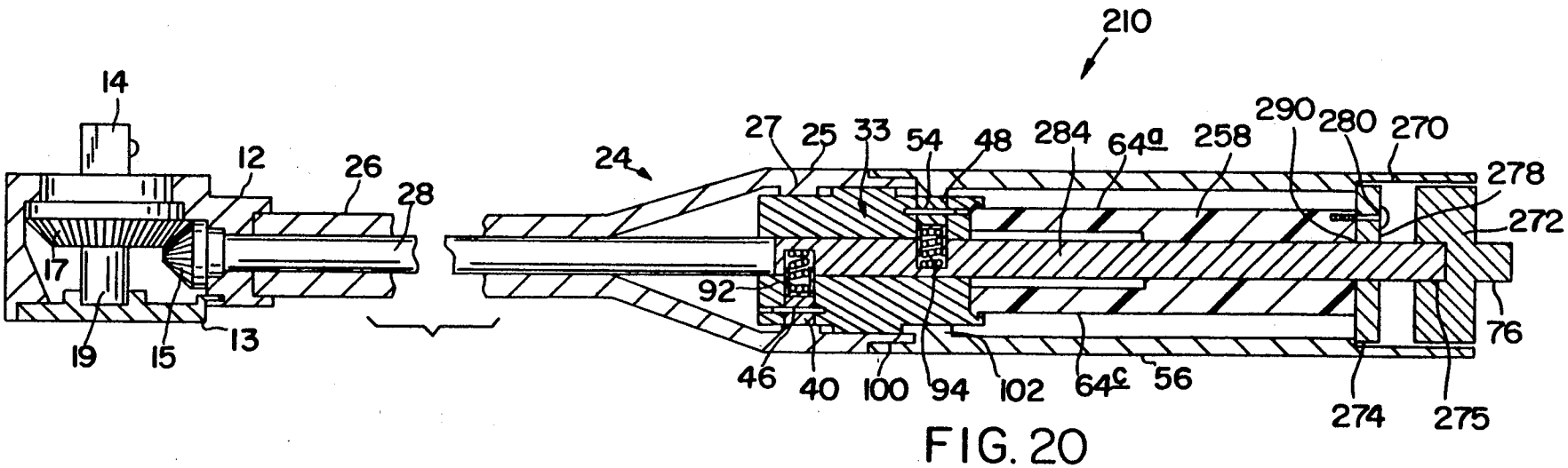
FIG. 20 is a sectional view of the wrench of FIG. 19.

Referring to FIGS. 19 & 20, it can be seen that the lever frame is designated by the numeral 210. The frame 210 has at one of its ends a conventional socket attachment 14 for receiving a socket (not shown). Male socket attachment 14 is fixed to circular plate 16 which rotatably seats within gear housing 12 by way of mount 19 which is rotatably mounted to bottom plate 13. Attached to the bottom surface of plate 16 is bevel gear 17 which is in gear meshing relationship with pinion gear 15. Gear housing 12 is rigidly connected to an elongated hollow housing 24. Hollow housing 24 has a cylindrical portion 26 and bell housing 25. Rotatably located within hollow housing 24 is drive shaft 28. Drive shaft 28 has at one of its ends a pinion gear rigidly affixed. At the other end of the shaft is rigidly affixed a tandem pawl carrier 33. Carrier 33 has two slots 30 and 34 which are axially spaced 180° apart and are longitudinally spaced apart. Pivotally mounted in slot 30 is pawl 240, by means of pivot pin 46 which fits through pawl aperture 45 and carrier aperture 32. Pawl 248 is pivotally mounted within second slot 34 by means of pin 54 which fits in pawl aperture 53 and carrier aperture 36. Pawls 240 and 248 each have a pair of engaging teeth which are designated by 42 and 44 for pawl 240 and 50 and 52 for pawl 248. These pawls are each moveable to a first and second position and engageable with ring gears 27 and 102.

Carrier 33 has a waist portion 31 which has an enlarged diameter and which provides a bearing surface between carrier 33 and a portion of the inside surface of bell housing when carrier is positioned within. When carrier is so positioned, pawl 240 is in location for engagement with ring gear 27 which is about the inside surface of a portion of bell housing 25. Carrier means has a portion which extends rearwardly of bell housing portion 25.

Hollow handle 56 is rotatably mounted to the rear portion of bell housing 25 so as to provide an adequate bearing surface. This rear portion is an annular recess 100 on which internal surface 101 of handle 56 rotates. Ring gear 102 is also nested within and concentric with surface 101 and is engagable with pawl 248, when handle is mounted to bell housing.

Housed within handle 56 is rod casing 258, which has four arms, **64*a*, 64*b*, 64*c* and 64*d* which each snap fit into recesses, 116*a*, 116*b*, 116*c* and 116*d* by means of respective ridges 110*a*, 110*b*, 110*c*, and 110*d*. In this arrangement rod 284 abuts the rearwardmost end of drive shaft 28. Rod 284 has two cavities, 88 and 89, which are 180° apart axially and are spaced apart longitudinally. Seated within each cavity are springs 90 and 94, which springs engage pins 292 and 296 forcing them against the inner surfaces 247 and 241 of the respective pawls 248 and 242. At the other end of rod 284 is selector knob 272 which has a cavity 275 for allowing a tight snap fit connection with rod 284. Selector knob has a raised section 76 for access with the user's fingers in turning rod 284 to desired engagement. Knob 272 is further defined as having a smaller diameter than the inside diameter 270 of the end of hollow handle 56. The reason for this is to prevent friction or drag of knob 272 on the internal surface 270** in use.

The 180° axial offset of pawls 240 and 248 helps to prevent binding between carrier 33, handle 56, and housing 25.

Disc 278 has an aperture 290 in its center larger than the outside diameter of rod 284 and fits around rod 284. Disc 278 is attached to rod casing 258 by means of screw 280. Disc 278 has an aperture 279 for allowing screw 280 to engage to casing 258 by means of a drilled and tapped hole 281 (FIG. 19). Disc 278 thus attached to rod casing 258 prevents hollow handle 56 from disengaging the bell housing bearing surface. This is accomplished by disc 278 riding on shoulder 274 of enlarged bore 270 at the end of the hollow handle 56. The diameter of disc 278 is also made smaller than the inside diameter of bore 270 to prevent drag and friction.

When knob 272 is turned to the right pin 292 engages concave surface **241*b* of pawl 240 and pin 296 engages concave surface 247*b* of pawl 248. The spring action from both pins seating in concave recesses of pawls places rod in stable condition for ratcheting; likewise when knob 272 is turned to the left the spring engaged pins and concave recesses on the surfaces of the pawls will likewise result in a stable condition for ratcheting. The contact of pins 292 and 296 in concave surfaces 241*a*, 241*b*, 247*a*, and 247*b*, stabilize rod 284 sufficiently that pin 80 and slot 74, shown in the embodiment of FIG. 1**, can be omitted.

As mentioned previously, the wrench of this invention is capable of tightening or loosening a nut or bolt with a ratchet action in two different modes. One of the modes is the conventional ratcheting mode, i.e., the lever frame 210 is rotated about a plane perpendicular to the thread axis of the nut or bolt. The other mode is described as "speed ratcheting" as the elongated grip can be ratcheted along its center longitudinal axis and the nut or bolt progressed at a much faster rate. To accomplish tightening, knob 272 is turned to the left; in this position pawl 240 is rotated so that teeth 44 engage ring gear 27 and pawl 248 is rotated so that teeth 50 engage ring gear 102. In this disposition the tandem carrier 33 and the shaft 28 are allowed righthand rotation as the teeth of ring gear 27 simply ride over the top of the pawl in a ratchet-like manner. However, lefthand rotation of tandem carrier 33 and shaft 28 are prevented as pawl teeth 44 achieve 10 locking engagement with the teeth of ring gear 27. Thus, conventional ratchet-ratcheting in a counter-clockwise direction is achieved as the shaft rotation disposition is transferred to the socket holding member through pinion gear 15 and bevel gear 17. A nut or bolt having a righthand thread can be tightened in a conventional manner. Now, in this disposition the user also has the option of achieving "speed ratcheting" by ratcheting the elongated handle 56 along its center longitudinal axis. When the handle is rotated to the right—the opposite direction from which knob 272 is turned—ring gear 102 achieves locking engagement with teeth 50 on pawl 248 and drives tandem carrier 33 in the same rotational direction with it.

As pointed out above in this paragraph, the tandem carrier 33 and shaft 28 are allowed righthand rotation with respect to ring gear 27 and pawl 240; thus, rotation of the handle 56 to the right also drives the work engaging piece 14 to achieve tightening of a nut or bolt. Furthermore, the user can simply ratchet the handle 56 as he or she progresses the nut or bolt. Handle 56 can be rotated in a left-hand direction as teeth of ring gear 102 simply ride over the top of pawl 248 in a ratchet like manner but tandem carrier 33 with attached shaft 28 is disallowed from turning in this direction, as pointed out in this paragraph above.

To accomplish loosening, knob 72 is turned to the right; in this position the entire sequence is simply revered. Pawl 240 is rotated so that teeth 42 engage ring gear 27 and pawl 248 is rotated so that teeth 52 engage ring gear 102. In this position tandem carrier 33 and shaft 28 are allowed a lefthand rotation as the teeth of ring gear 27 simply ride over the top of teeth 42 of pawl 240, but are disallowed from rotation in a righthand direction as teeth 42 engage ring gear 27. The ring gear 102 in handle 56 engages teeth 52 on pawl 248 when the handle is turned in a left-hand direction but ride over teeth 52 when the handle 56 is turned in a righthand direction. In this disposition conventional loosening of a nut or bolt is possible but the added facility of "speed ratcheting" the handle is also present.

By simply turning a single knob 76 to one of two positions four possible modes of ratcheting are possible: tightening and loosening a nut or bolt by the conventional method or tightening or loosening a nut or bolt by "speed ratcheting".

As also mentioned previously, the wrench of this invention achieves a most desirable feature which is not present in other dual mode ratchet wrenches. Other dual mode ratchet wrenches characteristically have very large heads because both the ratcheting mechanisms and the gears are housed in the head. The ratcheting mechanisms in this wrench are housed in the hollow handle 56, therefore the socket holding housing 12 can be made very small as it accommodates only the meshing gears 15 and 17 with socket attachment 14 and mount 19. In this design the greater torque generated in conventional ratcheting must be transmitted from the socket attachment 14 through the gears 15 and 17 and the shaft 28 to the ratchet mechanism 33. The diameter and length of shaft 28 are critical in transmitting the desired torque. In other words, the shaft must be substantial enough and this is achieved by reducing the length and increasing the diameter. As clearly shown in FIG. 20 the shaft in this design is reduced to the possible minimum, extending from the pinion gear 15 to the proximal point on carrier 33. It is also isolated from other functioning parts and the diameter can therefore be made as large as desired without conflict of other parts. This s clearly another improvement over the '617 patent in which the shaft extends from the pinion gear to the most distal point of the hollow handle and interfaces with the ratcheting mechanisms. In other words, the shaft of the '617 patent is approximately twice the length and must be reduced in diameter to accommodate other working parts.

There is an essential conceptual difference between the '617 patent and the present invention. The difference is demonstrated when both tools are used to ratchet in the conventional manner. For the sake of illustration the user will be tightening a bolt. Using the '617 patent tool, the user places the socket on socket on male extension 14 and then places the socket on the bolt head. The user then grips the handle 106 and pulls from right to left; the tighter the bolt becomes the greater the force which must be applied in this direction. Let us say the user achieved tightening at 40 ft.-lbs; as he pulls against the handle with 40 ft.-lbs, this torque is transmitted from the socket extension 14 through gear 15 to shaft 28 through pawl 54 and ring gear 56 and continuing through handle 106 and finally to pawl 38 and ring gear 44, which prevents handle 106 from rotating. In other words, the tubular handle 106 is in torsion as the torque is finally transmitted through same to second ratchet, i.e., pawl 38 and ring gear 44.

Using the tool of the present invention in the same manner, the desired 40 ft.-lbs of pressure is transmitted through gear 15 to shaft 28 but finally to pawl 40 and ring gear 27. The handle 56 and second ratchet arrangement including pawl 48 and ring gear 50 are not in torsion; they are not an essential part for the conventional ratcheting function. It is because of this fundamental difference that the tool of the present invention has a function which is not present in the '617 patent tool. In other words, the handle 56 can be ratcheted along its longitudinal axis. The handle 106 in the '617 patent tool can be turned in only one direction.

Carrier 33 acts as a torque-transference means for transferring torque between handle 56 and shaft 28.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A wrench comprising:

a) a socket-holding means (14) for holding a socket in engagement with the wrench, the socket-holding means being rotatably housed in a first housing (12);

b) an elongated, hollow, second housing (24) having a first end and a second end which holds, at its first end and in non-rotatable relationship therewith, the first housing (12) and which has, at a location proximal to its second end, a first engagement means 27);

c) a shaft (28) rotatably mounted within the hollow housing (24);

d) coupling means (15, 17) cooperative with the socket-holding means (14) and the shaft (28) whereby the rotation of the shaft (28) about its longitudinal axis effects rotation of the socket holding means (14) and whereby rotation of the socket holding means (14) effects rotation of the shaft (28) about its longitudinal axis;

e) first shaft rotation control means (40) coupled to the shaft (28) and selectively movable between a first position and a second position wherein, at the first position, the first shaft rotation control means (40) is engaged with the first engagement (27) means whereby the shaft (28) is only allowed right-hand rotation and, at the second position, the first shaft rotation control means (40) is engaged with the first engagement means (27) whereby the shaft (28) is only allowed lefthand rotation;

f) an elongated handle (56) rotatably mounted to the hollow housing (24), the elongated handle (56) having second engagement means (102);

g) second shaft rotation control means (48) coupled to the shaft (28) and selectively movable to a first position and a second position, at the first position, the second shaft rotation control means (48) is engaged with the second engagement means (102) whereby righthand rotation of the handle imparts a righthand rotation to the shaft (28) and, at the second position, the second shaft rotation control means (48) is engaged with the second engagement means (102) whereby lefthand rotation of the handle (56) imparts a lefthand rotation to the shaft (28); and h) selection means (72, 84) in association with the first and second rotation control means (40, 48) for effecting their movement to their respective first and second positions, wherein movement of the first engagement means is independent of movement of the second engagement means, allowing the wrench to ratchet when the handle is rotated about its longitudinal axis and to ratchet when the handle is swung around an axis perpendicular to its longitudinal axis.

2. The wrench of claim 1, wherein:

the first and second shaft rotation control means are mounted to a carrier means (33), the carrier means (33) being rigidly attached to the shaft (28) and coupled to the selection means (72, 84), and the carrier means (33) acting as a torque-transference means for transferring torque between the handle and the shaft.

3. The wrench of claim 2, wherein:

the elongated handle (56) is hollow and the carrier means (33) is partially housed within the elongated hollow housing (24) and partially housed within the elongated handle (56).

4. The wrench of claim 1, wherein:

the first and the second engagement means are first (27) and second (102) ring gears, respectively, and the first and second shaft rotation control means are first (40) and second pawls (48), respectively.

5. The wrench of claim 4, wherein:

the first and second pawls are mounted to a carrier means (33), the carrier means (33) being rigidly connected to the shaft and coupled to the selection means (72, 84), and the carrier means (33) acting as a torque-transference means for transferring torque between the handle and the shaft 6. The wrench of claim 5, wherein:

the selection means is a rod (84) rotatably coupled with the carrier means, the rod (84) having a pawl movement means (88, 90, 92; 89, 94, 96) for each pawl (40, 48) to move each pawl to its respective first and second position upon rotative movement of the rod (84).

7. The wrench of claim 6, wherein:

the pawls are pivotally mounted to the carrier means (33) and the pawl movement means are rocker means (88, 90, 92; 89, 94, 96) which rock the pawls (40, 48) about their pivots to achieve their respective first and second positions.

8. The wrench of claim 7, wherein:

the pawls (40, 48) are pivotally mounted 180° apart axially from one another and are longitudinally spaced apart from one another.

9. The wrench of claim 8, wherein:

the elongated handle (56) is hollow and the carrier means (33) is partially housed within the elongated hollow housing (24) and partially housed within the elongated handle (56).

10. The wrench of claim 1 wherein:

the shaft (28) has a first end and a second end, the first end of the shaft being adjacent the first end of the second housing, and the second end of the shaft being adjacent the second end of the second housing.

11. The wrench of claim 1 wherein:

the second shaft rotation control means is mounted 180° axially apart from and longitudinally spaced from the first shaft rotation control means.

12. A wrench comprising:

a) a socket-holding means (14) for holding a socket in engagement with the wrench, the socket-holding means being rotatably housed in a first housing (12);

b) an elongated, hollow, second housing (24) having a first end and a second end which holds, at its first end and in non-rotatable relationship therewith, the first housing (12) and which has, at a location proximal to its second end, a first engagement means (27);

c) a shaft (28) having a first end and a second end, the shaft being rotatably mounted within the hollow housing (24), the first end of the shaft being adjacent the first end of the second housing, and the second end of the shaft being adjacent the second end of the second housing;

d) coupling means (15, 17) cooperative with the socket-holding means (14) and the shaft (28) whereby the rotation of shaft (28) about its longitudinal axis 20 effects rotation of the socket holding means (14);

e) first shaft rotation control means (40) coupled to the shaft (28) and selectively movable between a first position and a second position wherein, at the first position, the first shaft rotation control means (40) is engaged with the first engagement (27) means whereby the shaft (28) is only allowed right-hand rotation and, at the second position, the first shaft rotation control means (40)is engaged with the first engagement means (27) whereby the shaft (28) is only allowed lefthand rotation;

f) an elongated handle (56) rotatably mounted to the hollow housing (24), the elongated handle (56) having second engagement means (102);

g) second shaft rotation control means (48) coupled to the shaft (28) and selectively movable to a first position and a second position, at the first position, the second shaft rotation control means (48) is engaged with the second engagement means (102 whereby righthand rotation of the handle imparts a righthand rotation to the shaft (28) and, at the second position, the second shaft rotation control means (48) is engaged with the second engagement means (102) whereby lefthand rotation of the handle (56) imparts a lefthand rotation to the shaft (28); and h) selection means (72, 84) in association with the first and second rotation control means (40, 48) for effecting their movement to their respective first and second positions.

13. The wrench of claim 12, wherein:

the first and second shaft rotation control means are mounted to a carrier means (33), the carrier means (33) being rigidly attached to the shaft (28) and coupled to the selection means (72, 84).

14. The wrench of claim 13, wherein:

the elongated handle (56) is hollow and the carrier means (33) is partially housed within the elongated hollow housing (24) and partially housed within the elongated handle (56).

15. A wrench comprising:

a) a socket-holding means (14) for holding a socket in engagement with the wrench, the socket-holding means being rotatably housed in a first housing (12);

b) an elongated, hollow, second housing (24) having a first end and a second end which holds, at its first end and in non-rotatable relationship therewith, the first housing (12) and which has, at a location proximal to its second end, a first engagement means (27);

c) a shaft (28) rotatably mounted within the hollow housing (24);

d) coupling means (15, 17) cooperative with the socket-holding means (14) and the shaft (28) whereby the rotation of shaft (28) about its longitudinal axis effects rotation of the socket holding means (14);

e) first shaft rotation control means (40) coupled to the shaft (28) and selectively movable between a first position and a second position wherein, at the first position, the first shaft rotation control means (40) is engaged with the first engagement (27) means whereby the shaft (28) is only allowed right-hand rotation and, at the second position, the first shaft rotation control means (40) is engaged with the first engagement means (27) whereby the shaft (28) is only allowed lefthand rotation;

f) an elongated handle (56) rotatably mounted to the hollow housing (24), the elongated handle (56) having second engagement means (102);

g) second shaft rotation control means (48) coupled to the shaft (28) and selectively movable to a first position and a second position, at the first position, the second shaft rotation control means (48) is engaged with the second engagement means (102 whereby righthand rotation of the handle imparts a righthand rotation to the shaft (28) and, at the second position, the second shaft rotation control means (48) is engaged with the second engagement means (102) whereby lefthand rotation of the handle (56) imparts a lefthand rotation to the shaft (28); and h) selection means (72, 84) in association with the first and second rotation control means (40, 48) for effecting their movement to their respective first and second positions, wherein the second shaft rotation control means is mounted 180° axially apart from and longitudinally spaced from the first shaft rotation control means.

16. The wrench of claim 15, wherein:

the first and second shaft rotation control means are mounted to a carrier means (33), the carrier means (33) being rigidly attached to the shaft (28) and coupled to the selection means (72, 84).

17. The wrench of claim 16, wherein:

the elongated handle (56) is hollow and the carrier means (33) is partially housed within the elongated hollow housing (24) and partially housed within the elongated handle (56).

18. The wrench of claim 15, wherein:

the first and the second engagement means are first (27) and second (102) ring gears, respectively, and the first and second shaft rotation control means are first (40) and second pawls (48), respectively.

19. The wrench of claim 18, wherein:

the first and second pawls are mounted to a carrier means (33), the carrier means (33) being rigidly connected to the shaft and coupled to the selection means (72, 84).

20. The wrench of claim 19, wherein:

the selection means is a rod (84) rotatably coupled with the carrier means, the rod (84) having a pawl movement means (88, 90, 92; 89, 94, 96) for each pawl (40, 48) to move each pawl to its respective first and second position upon rotative movement of the rod (84).

* * * * *